US006079782A

United States Patent [19]

Berg et al.

[11] Patent Number: 6,079,782

[45] Date of Patent: Jun. 27, 2000

[54] SEAT CONSTRUCTION WHICH CORRECTS THE PELVIS SO THAT IT INFLUENCES A PROPER ALIGNMENT OF THE HUMAN BODY

[75] Inventors: Joseph A. Berg; Eugene Wheat, both of Bakersfield, Calif.

[73] Assignee: Jean Baughman, Bakersfield, Calif.; a part interest

[21] Appl. No.: 09/240,296

[22] Filed: Jan. 29, 1999

[51] Int. Cl.[7] ..... A47C 3/025

[52] U.S. Cl. ..... 297/284.3; 297/312; 297/452.55; 297/183.1

[58] Field of Search ..... 297/312, 313, 297/258.1, 270.1, 270.3, 452.5, 452.55, 452.49, 201, 183.1, 183.5, 250.1, 195.1, 214, 284.1, 284.3; 248/560, 603, 618; 5/652, 654.1

[56] References Cited

U.S. PATENT DOCUMENTS

| | | |
|---|---|---|
| 199,535 | 1/1878 | Granger . |
| 2,139,028 | 12/1938 | Mensendicck et al. . |
| 2,799,323 | 7/1957 | Berg . |
| 3,058,778 | 10/1962 | Campbell . |
| 3,080,195 | 3/1963 | Berg . |
| 3,749,442 | 7/1973 | Berg . |
| 4,047,757 | 9/1977 | Berg . |
| 4,372,606 | 2/1983 | Faull . |
| 5,024,485 | 6/1991 | Berg . |
| 5,288,127 | 2/1994 | Berg . |
| 5,577,801 | 11/1996 | Glockl . |
| 5,597,203 | 1/1997 | Hubbard . |
| 5,722,729 | 3/1998 | Carilli . |

*Primary Examiner*—Milton Nelson, Jr.
*Attorney, Agent, or Firm*—Thomas I. Rozsa; Tony D. Chen; Jerry Fong

[57] ABSTRACT

A seat construction corrects the pelvis so that it influences a proper alignment of the body. The seat construction has at least four independent seat assemblies which are supported by a base plate. Each seat assembly includes a frame shaped support affixed to the base plate, a rigid support plate affixed to the top of the frame shaped support, and a full foam seat cushion affixed to the top of the support plate. In an alternative embodiment, the seat construction has at least four independent seat assemblies which are supported by a base plate. Each seat assembly includes a frame shaped support affixed to the base plate, a rigid support plate affixed to the top of the frame shaped support, and a full foam seat cushion affixed to the top of the support plate. Each seat assembly further includes at least three springs embedded within the frame shaped support for further supporting the weight of an individual to improve the posture of the individual by more efficiently supporting the weight of the individual who sits on the seat construction and adjusting the height of the independent seat sections to accommodate movement of the individual sitting in the seat construction.

38 Claims, 4 Drawing Sheets

SEAT CONSTRUCTION WHICH CORRECTS THE PELVIS SO THAT IT INFLUENCES A PROPER ALIGNMENT OF THE HUMAN BODY

BACKGROUND OF THE INVENTION

1. Field of the Invention

The present invention generally relates to the field of posture chairs. More particularly, the present invention relates to the field of therapeutic seat designs and constructions for improving the posture of an individual by more efficiently supporting the weight of the individual who sits on the seat to accommodate movement of the individual in the seat.

The present invention also generally relates to the fields of any type of seating which includes seating for automobiles, motorcycles and recreational seating. In addition, the present invention can be used therapeutically to improve the posture of an individual, both passively and effectively.

One must be aware that a person when they sit are dead weight. There is no way of bringing circulation to the pelvic area of the tuberosities, a necessary requirement so that one can sit for longer periods of time.

2. Description of the Prior Art

In general, posture chairs and various seat configurations used as an integral part of the posture chair are well known in the art. One of the inventors of the present invention is Joseph A. Berg and is a pioneer in having developed and patented several seating arrangements which have helped to provide greater comfort to individuals as they sit on a seat. The following patents have been issued to either inventor Joseph A. Berg individually or to co-inventors Joseph A. Berg and Loren W. Eames or Joseph A. Berg and Thomas E. Violand, Jr.

1. U.S. Pat. No. 2,799,323 issued Joseph A. Berg on Jul. 16, 1957 for "Self-Aligning Seat Construction" (hereafter the "'323 Patent");
2. U.S. Pat. No. 3,080,195 issued Joseph A. Berg on Mar. 5, 1963 for "Self-Aligning Seat Construction" (hereafter the "'195 Patent");
3. U.S. Pat. No. 3,749,442 issued Joseph A. Berg and Loren W. Eames on Jul. 31, 1973 for "Seat Having Relatively Adjustable Sections" (hereafter the "'442 Patent");
4. U.S. Pat. No. 4,047,757 issued Joseph A. Berg and Loren W. Eames on Sep. 13, 1977 for "Seating Structures With Flexible Backs" (hereafter "the '757 Patent");
5. U.S. Pat. No. 5,024,485 issued Joseph A. Berg and Loren W. Eames on Jun. 18, 1991 for "Front And Back Adjustable Rocking Seat Support Arrangement For Seat Having Relatively Adjustable Sections" (hereafter the "'485 Patent"); and
6. U.S. Pat. No. 5,288,127 issued Joseph A. Berg and Thomas E. Violand, Jr. on Feb. 22, 1994 for "Rocking Seat" (hereafter the "'127 Patent").

In each of these patents, the object was to provide a seat construction which readily responded to or accommodated itself to the position of the body of the person occupying it. The object was to provide a seat which was self-aligning and which was so constructed that it allowed each side of the body of the occupant of the seat to move normally and independently of the other without restraint.

The '323 Patent discloses a seat having two separate halves. Each half is supported independently by coil spring members mounted between the seat half and the base plate.

The '195 Patent discloses an improvement over the '323 Patent. The seat disclosed in the '195 Patent also includes two separate independent halves. Each half is supported by a resilient cushioning pad placed underneath the seat half.

The '757 Patent discloses a seat unit having a flexible seat back. The seat back is separated into two halves to support a user's back at opposite sides of the user's spine.

The '422 Patent discloses an improvement over the '323 Patent and the '195 Patent. Each seat half of the '422 Patent is supported by a universal joint support which allows the seat half to be rocked. Each seat half further comprises a localized recess offset rearwardly from the universal joint for receiving the ischial tuberosity bones of the user of the seat.

The '485 Patent discloses an improvement over the '442 Patent. The improvement of the '485 Patent comprises a seat rocking means such as a cylindrical rod affixed to the lower portion of each seat half and a pair of spaced apart resilient receiving means for each seat half to movably and rotatably support a seat half on the base of the seat. The improvement restricts the movement of each separate seat section to move only back and forth in a longitudinal rocking motion as compared to the universal movement of the '442 Patent.

The '127 Patent discloses a rocking seat. It includes a pair of seat halves, wherein each seat half has a seat rocking member such as an arch shaped suspension affixed to the lower portion of each seat half and affixed at only one side to the upper surface of a base. The resilience of the arch shape suspensions permits and limits the seat to move downwardly and slide backwardly, when a force such as the weight of a person pushes downwardly on the seat. The resilience of the arch shape suspensions further permits and limits the seat to rock back and forth to thereby enable the user to independently rock back and forth in a front to back rocking motion on each seat half.

The seat having adjustable sections as disclosed and claimed in the '485 Patent had many beneficial effects. However, one disadvantage of the '485 Patent is that it has too many mechanical moving components and it is therefore too expensive to manufacture. Another disadvantage of the '485 Patent is that an adjustable device has to be used to limit the amount of front rocking motion. The adjustable device was created for that purpose only and it adds additional mechanical requirements. Therefore, to correct this problem with the seating arrangement disclosed in the '485 Patent, it is necessary to eliminate the adjustable device and also to reduce the mechanical components on the seating arrangement. Another purpose is to reduce the cost in manufacturing the seating arrangement for the consumer sector.

Various other posture seating and seat arrangements are known in the art and the following patents are representative of such arrangements:

1. U.S. Pat. No. 199,535 issued to Granger on Jan. 22, 1878 for "Sewing Machine Chairs" (hereafter the "Granger Patent");
2. U.S. Pat. No. 2,139,028 issued to Mensendicck et al. on Dec. 6, 1938 for "Seat" (hereafter the "Mensendicck Patent");
3. U.S. Pat. No. 5,577,801 issued to Glockl on Nov. 26, 1996 for "Active Dynamic Seat" (hereafter the "Glockl Patent"); and
4. U.S. Pat. No. 5,597,203 issued to Hubbard on Jan. 28, 1997 for "Seat With Biomechanical Articulation" (hereafter the "Hubbard Patent").

The Granger Patent discloses a sewing machine chair. It comprises three parallel support plates wherein each support plate is supported by three springs.

The Mensendicck Patent discloses a seat.

The Glockl Patent discloses an active dynamic seat. It comprises a base, an intermediate piece linked to the base and a seating part linked to the intermediate piece. The seating part is two parallel support plates which can independently tilt backwards and forwards.

The Hubbard Patent discloses a seat with a biomechanical articulation. It comprises three separate support areas including a pair of thigh supports and a rear seat member. The thigh supports are pivotally attached to the seat member to provide individual movement when the person's legs are in positions such as while operating a machine that requires different movements of the person's legs.

It is desirable to have a very efficient and also very effective design and construction of a seat construction for improving the posture of an individual by more efficiently supporting the weight of the individual who sits on the seat construction to accommodate movement of the individual in the seat.

SUMMARY OF THE INVENTION

The present invention is a novel and unique seat construction having at least four independent seat assemblies.

It has been discovered, according to the present invention, that by providing a seat construction having at least four independent seat assemblies, each such independent seat assembly corrects the pelvis so that it influences a proper alignment of a person's body.

It has been further discovered, according to the present invention, that providing a seat construction having at least four independent seat assemblies (1) improves the posture of the individual by more efficiently supporting the weight of the person who sits on the seat construction; (2) corrects the pelvis so that it influences a proper alignment of the person's body; and (3) adjusts the movement of the person sitting in the seat construction.

It is an object of the present invention to provide a seat construction having at least four independent seat assemblies which are specifically adjusted to conform to the demands of the individual users.

It is also an object of the present invention to provide a seat construction having at least four independent seat assemblies which are specifically designed and constructed to support the weight of a person with greater comfort than conventional chairs, and to do so in a manner which corrects the pelvis and aligns the body.

It is an additional object of the present invention to provide a seat construction which is portable so that it can be carried to any plurality of locations such as sporting events, picnics, etc.

It is a further object of the present invention to provide a seat construction which is affordable for the consumer sector.

In the preferred embodiment of the present invention, the seat construction has at least four independent seat assemblies which include front and rear left seat assemblies, and front and rear right seat assemblies, all of which are supported by a base plate. Each seat assembly includes elastic means affixed to the base plate, a rigid support plate affixed to the top of the elastic means, and a full foam cushion affixed to the top of the support plate.

In an alternative embodiment of the present invention, the seat construction has at least four independent seat assemblies which include front and rear left seat assemblies, and front and rear right seat assemblies, all of which are supported by a base plate. Each seat assembly includes elastic means affixed to the base plate, a rigid support plate affixed to the top of the elastic means, and a full foam cushion affixed to the top of the support plate. Each seat assembly further includes at least three springs embedded within the elastic means for further supporting the weight of an individual to improve the posture of the individual by more efficiently supporting the weight of the individual who sits on the seat construction and corrects the pelvis to influence the proper alignment and accommodates movement of the individual sitting in the seat construction.

There are 19 muscles that influence movement of the pelvis and these are illustrated in Chart 1 on Page 10, and there are an additional 9 muscles that influence movement of the spine and lumbar vertebrae and these are illustrated in Chart 2 on Page 11. The present invention with its four movable plates is capable of relaxing these muscles and aligning them into the physiological function of the human machine, passively and painlessly. Many prominent medical sources confirm the necessity of seating that can take out the feeling of dead weight, but a seat that can give a freedom of support and a feeling of no fatigue or tiredness after the day of work is accomplished through use of the present invention seat.

The pelvis is the fulcrum of the spine and is also considered the fulcrum, which can and does effect the upper and lower parts of the body. A pelvis misalignment not only effects the contiguous structure of that area, but also effects the entire spine. This is a classic example, where the whole is greater than the sum of its parts.

The present invention seat by its configuration of four movable parts each influences the individual movement of muscles that adapt the body to an alignment for better comfort and wellness and less fatigue, affecting the whole body to an acceptable feeling of well-being and relaxation. This is affected by the pelvis and influence of the 19 muscles of the pelvis that have six functions of flexion, extension, abduction, adduction, lateral rotation and medial rotation and the nine muscles of the spine that have four functions of flexion, lateral flexion, extension and rotation.

CHART 1
MOVEMENT OF HIP

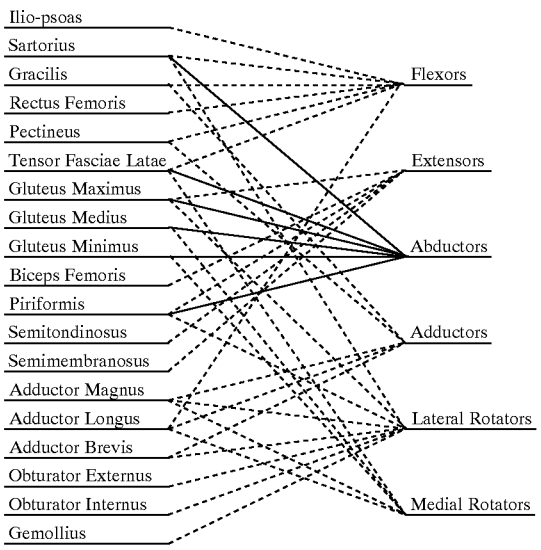

CHART 2
MOVEMENT OF THE SPINE

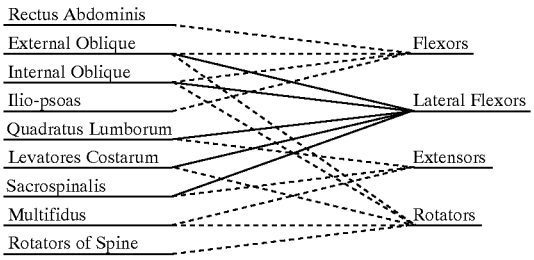

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
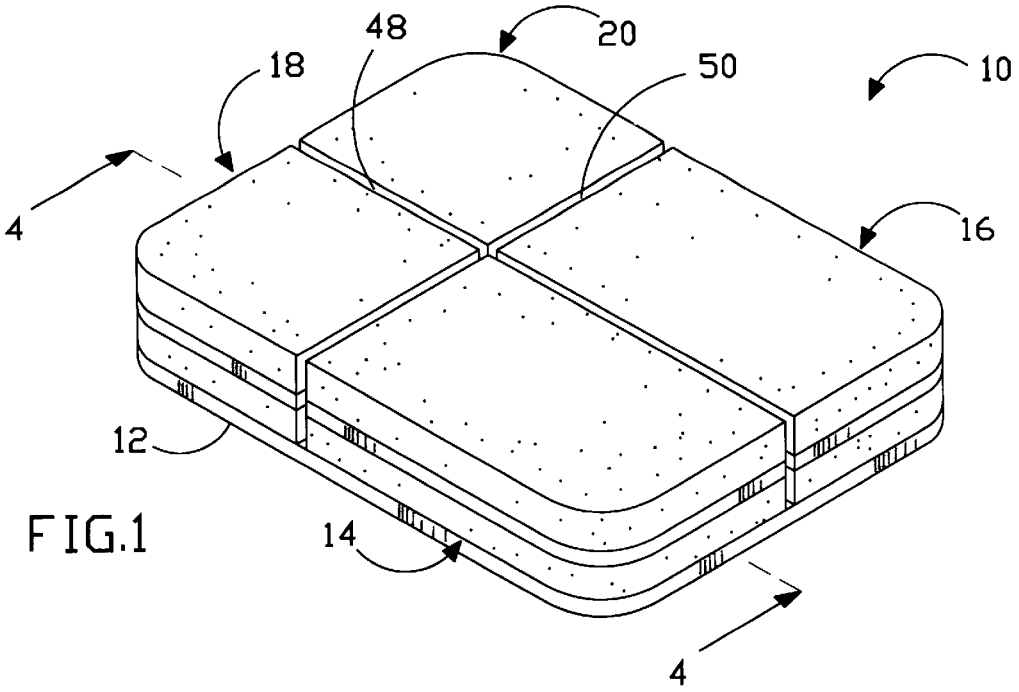
FIG. 1 is a perspective view of a preferred embodiment of the present invention seat construction.
Figure 2:
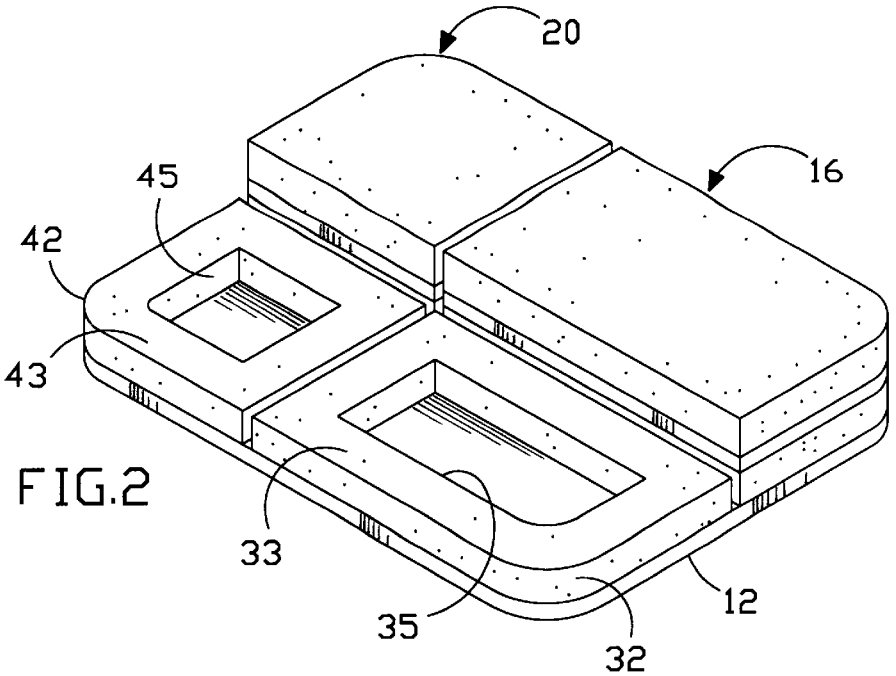
FIG. 2 is a perspective view of the present invention seat construction shown in FIG. 1, without front and rear left seat cushions, and front and rear left rigid support plates.
Figure 3:
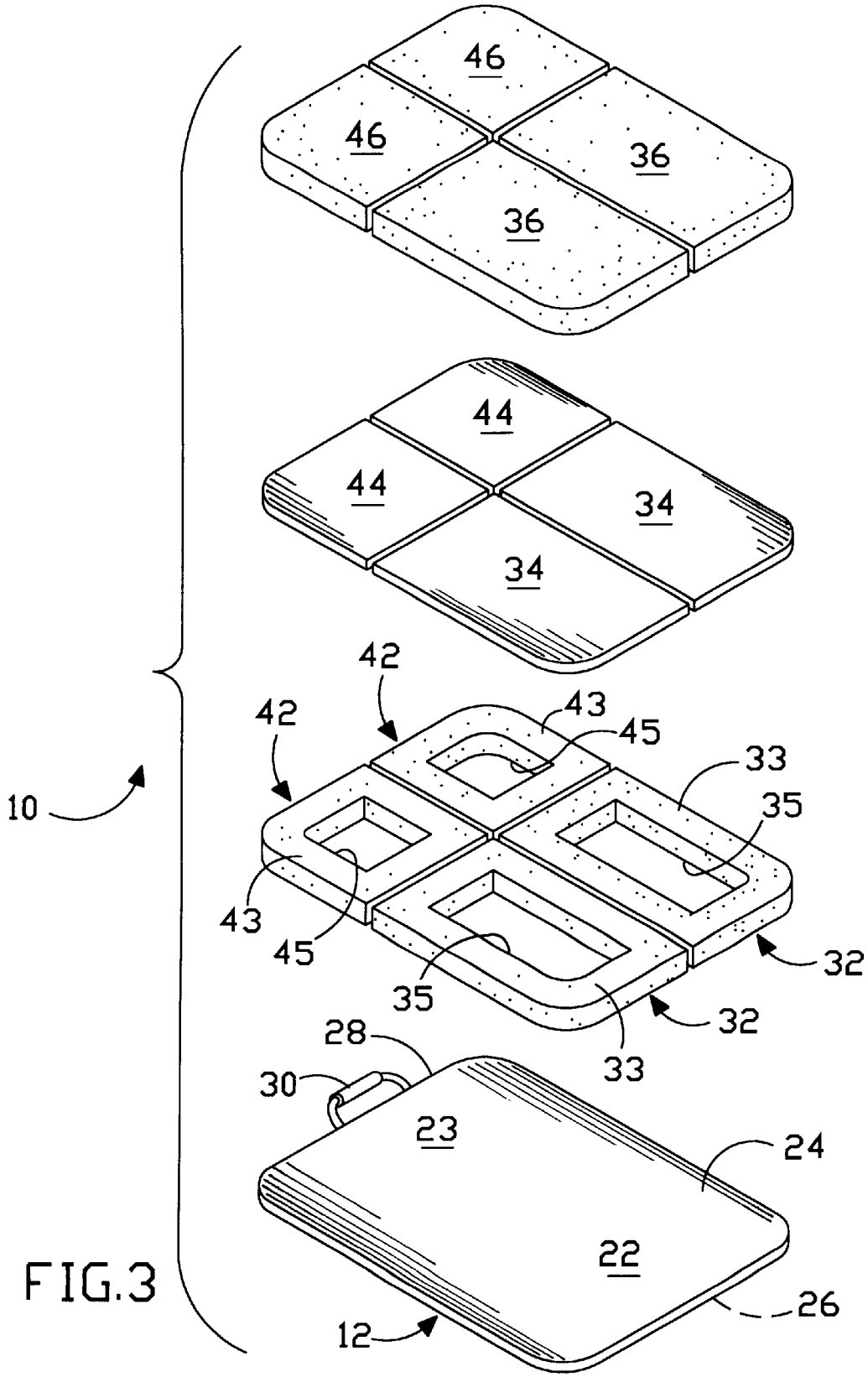
FIG. 3 is an exploded perspective view of the present invention seat construction shown in FIG. 1.

Referring to FIG. 1, there is shown at 10 a preferred embodiment of the present invention portable seat construction which corrects the pelvis so that it influences a proper alignment of the body. The portable seat construction 10 is adapted to be placed on any chair, automobile seat, or other supporting surface (not shown). The seat construction 10 includes a rigid base plate 12 and four independent seat assemblies, including a pair of complementary front seat assemblies 14 and 16, and a pair of complementary rear seat assemblies 18 and 20. The seat construction 10 may be covered by a fabric covering material (not shown).

Referring to FIGS. 1, 2, 3 and 4, the base plate 12 preferably takes the form of a flat or planar sheet of material. The base plate 12 has burred comers for preventing injures, an upper surface 24, and a lower surface 26. There is provided a handle 30 which is attached to a rear end 28 of the base plate 12 for carrying the seat construction 10 to any plurality of locations such as sporting events, picnics, etc.

The pair of complementary front seat assemblies 14 and 16 are an exact mirror-image of each other, and only one will be introduced in detail in the following disclosure, unless otherwise explicitly indicated. Each front seat assembly includes an elastic means 32, a rigid support plate 34, and a seat cushion 36. The elastic means 32 is a generally resilient frame shaped configuration which has a periphery 33 surrounding a cavity 35. The periphery 33 of the elastic means 32 is affixed to the front section 22 of the base plate 12 by adhesive means or any other suitable means known to one skilled in the art. The rigid support plate 34 is affixed to the top of the elastic means 32 by adhesive means or any other suitable means known to one skilled in the art and positioned to cover the cavity 35. The seat cushion 36 is positioned and affixed to the top of the support plate 34 by adhesive means or any other suitable means known to one skilled in the art.

The pair of complementary rear seat assemblies 18 and 20 are an exact mirror-image of each other, and only one will be introduced in detail in the following disclosure, unless otherwise explicitly indicated. Each rear seat assembly includes an elastic means 42, a rigid support plate 44, and a seat cushion 46. The elastic means 42 is generally resilient frame shaped configuration which has a periphery 43 surrounding a cavity 45. The elastic means 42 is affixed to the rear section 23 of the base plate 12 by adhesive means or any other suitable means known to one skilled in the art. The rigid support plate 44 is affixed to the top of the elastic means 42 by adhesive means or any other suitable means known to one skilled in the art and positioned thereto to cover the cavity 45. The seat cushion 46 is positioned and affixed to the top of the support plate 44 by adhesive means or any other suitable means known to one skilled in the art.

Referring to FIG. 1, the front seat assemblies 14 and 16 support the thighs of a person who sits on the seat construction 10 while the rear seat assemblies 18 and 20 support the pelvis of the person. The front and rear seat assemblies 14, 16, 18, and 20 are positioned adjacent each other but spaced apart by longitudinal and transverse narrow gaps 48 and 50, respectively, to permit each seat assembly to move independently of each other, where the front and rear seat assemblies follow the body's movement to accommodate the movement of the individual's body to influence the alignment of the pelvis.

In operation, when a downward force is exerted on the seat construction 10 such as a person sitting thereon, the four independent seat assemblies move independent of one another, thereby providing the person with a feeling of resilience and comfort to show that the seat construction has some give and play. The uniqueness of the seat construction 10 is that it follows the person's body movement as it rocks front to back, and further providing a flowing action to adjust and align the body of the individual as he or she sits on the seat construction. This is accomplished by the elastic means 32 and 42 which give when a downward force is exerted thereto. In addition, the four independent seat assemblies 14, 16, 18, and 20 provide less fatigue to a person sitting on the seat construction 10.

Figure 4:
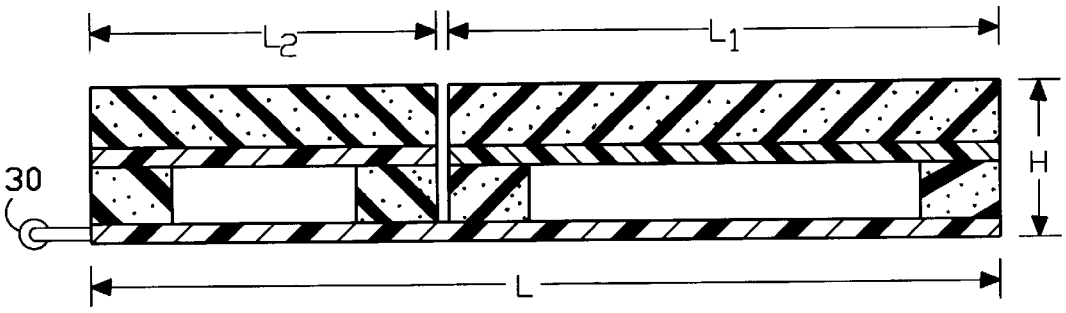
FIG. 4 is an enlarged cross-sectional view taken along line 4—4 of FIG. 1.
Figure 8:
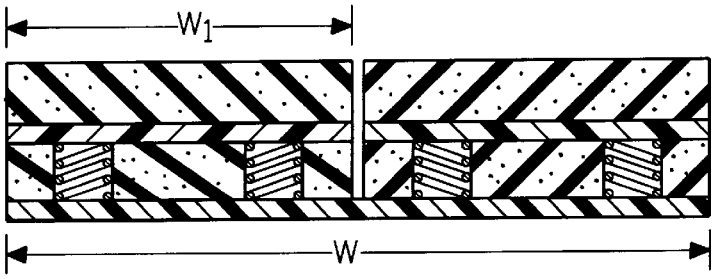
FIG. 8 is an enlarged cross-sectional view taken along line 8—8 of FIG. 5.

Referring to FIGS. 1, 4, and 8, by way of example, the overall length L, width W and height H of the seat construction 10 are approximately 16 inches by 13½ inches by 3 inches respectively. The front seat assemblies 14 and 16 are longer than the rear seat assemblies 18 and 20. By way of example, the length $L_1$ and width $W_1$ of the front seat assembly are approximately 9 inches by 6½ inches respectively. By way of example, the length $L_2$ and width $W_1$ of the rear seat assembly are approximately 6½ inches by 6½ inches respectively. It will be appreciated that the dimensions described above are merely one illustrative embodiment and can include many other comparable sets of dimensions.

The present invention conforms to conventional forms of manufacture or any other conventional way known to one skilled in the art. By way of example, the base plate 12, and the rigid support plates 34 and 44 can be made of plastic or metal material. By way of example, the elastic means 32 and 42, and the seat cushions 36 and 46 can be made of foam material, for example neoprene material.

Figure 5:
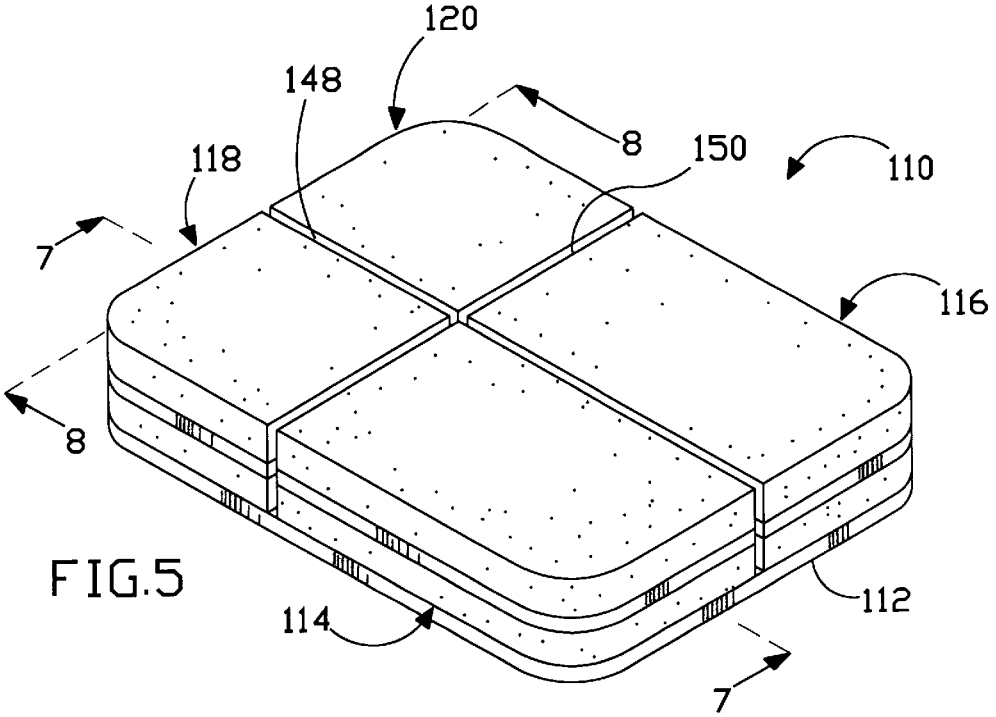
FIG. 5 is a perspective view of an alternative embodiment of the present invention seat construction.

Referring to FIG. 5, there is shown an alternative embodiment of the present invention portable seat construction 110. This alternative embodiment of the present invention seat construction is very similar to the preferred embodiment just discussed and all of the parts are numbered correspondingly with 100 added to each number. The portable seat construction 110 corrects the pelvis so that it influences a proper alignment of the human body. The seat construction 110 is adapted to be placed on any chair, automobile seat, or other supporting surface (not shown). The seat construction 110 includes a rigid base plate 112 and four independent seat assemblies, including a pair of complementary front seat assemblies 114 and 116, and a pair of complementary rear seat assemblies 118 and 120. The seat construction 110 may be covered by a fabric covering material (not shown).

Figure 7:
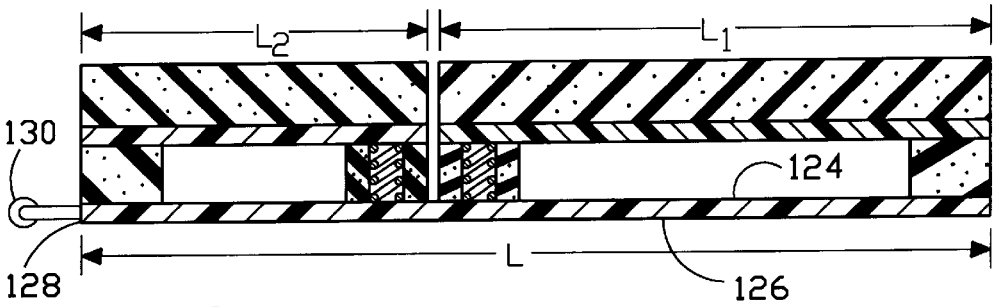
FIG. 7 is an enlarged cross-sectional view taken along line 7—7 of FIG. 5.
Figure 6:
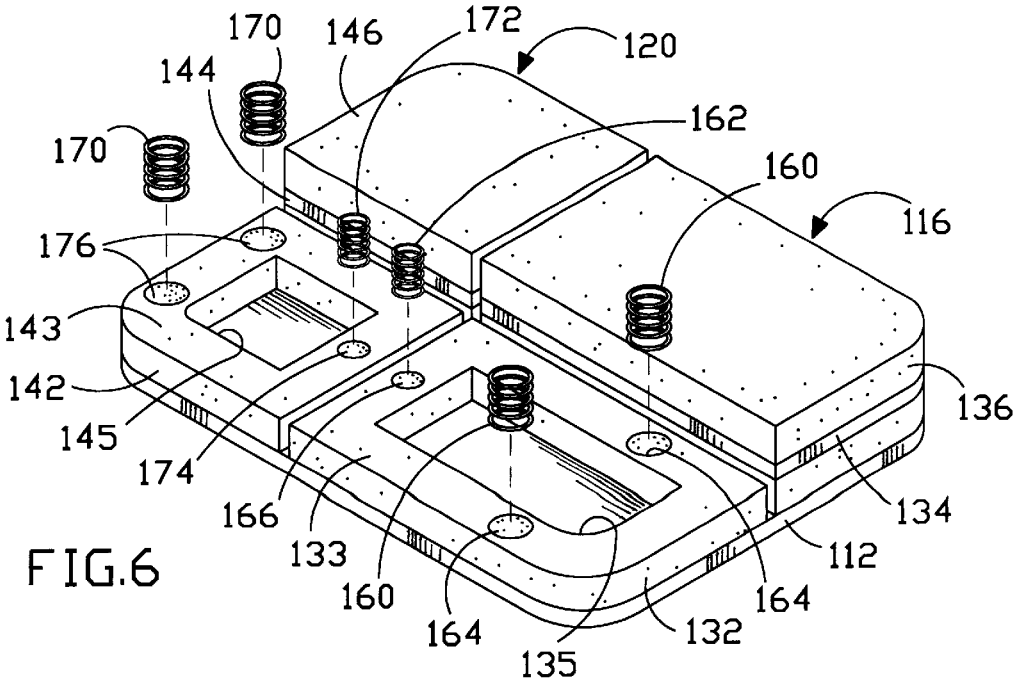
FIG. 6 is a partial exploded perspective view of the seat construction shown in FIG. 5.

Referring to FIGS. 5, 6, and 7, the base plate 112 preferably takes the form of a flat or planar sheet of material. The base plate 112 has burred corners for preventing injures, an upper surface 124, and a lower surface 126. There is provided a handle 130 which is attached to a rear end 128 of the base plate 112 for carrying the seat construction 110 to any plurality of locations such as sporting events, picnics, etc.

The pair of complementary front seat assemblies 114 and 116 are an exact mirror-image of each other, and only one will be introduced in detail in the following disclosure, unless otherwise explicitly indicated. Each front seat assembly includes an elastic means 132, a rigid support plate 134, a seat cushion 136, a pair of heavy duty springs 160, and a light spring 162. The elastic means 132 is a generally resilient frame shaped configuration which has a periphery 133 surrounding a cavity 135. The periphery 133 of the elastic means 132 is affixed to the front section of the base plate 112 by adhesive means or any other suitable means known to one skilled in the art. The periphery 133 has a pair of opposite cylindrical bores 164 located on the lengthwise portions of the elastic means 132 and a rear cylindrical bore 166 located on the center-width of the rear transverse portion of the elastic means 132. These bores are used for retaining the springs therein. The pair of heavy duty springs 160 are respectively disposed within the cylindrical bores 164 while the light spring 162 is disposed within the cylindrical bore 166. The rigid support plate 134 is affixed to the top of the elastic means 132 by adhesive means or any other suitable means known to one skilled in the art and positioned to cover the cavity 135 and the springs 160 and 162. The seat cushion 136 is positioned and affixed to the top of the support plate 134 by adhesive means or any other suitable means known to one skilled in the art.

The pair of complementary rear seat assemblies 118 and 120 are an exact mirror-image of each other, and only one will be introduced in detail in the following disclosure, unless otherwise explicitly indicated. Each rear seat assembly includes an elastic means 142, a rigid support plate 144, a seat cushion 146, a pair of heavy duty springs 170, and a light spring 172. The elastic means 142 is a generally resilient frame shaped configuration which has a periphery 143 surrounding a cavity 145. The elastic means 142 is affixed to the rear section of the base plate 112 by adhesive means or any other suitable means known to one skilled in the art. The periphery 143 has a front cylindrical bore 174 located on the center-width of the front transverse portion of the elastic means 142, and a pair of rear cylindrical bores 176 located on the rear transverse portion of the elastic means 142. These cylindrical bores are used for retaining the springs therein. The light spring 172 is disposed within the cylindrical bore 174 while the pair of heavy duty springs 170 are respectively disposed within the cylindrical bores 176. The rigid support plate 144 is affixed to the top of the elastic means 142 by adhesive means or any other suitable means known to one skilled in the art and positioned thereto to cover the cavity 145, and the springs 170 and 172. The seat cushion 146 is positioned and affixed to the top of the support plate 144 by adhesive means or any other suitable means known to one skilled in the art.

Referring to FIG. 5, the front seat assemblies 114 and 116 support the thighs of a person who sits on the seat construction 110 while the rear seat assemblies 118 and 120 support the pelvis of the person. The front and rear seat assemblies 114, 116, 118, and 120 are positioned adjacent to each other but space by longitudinal and transverse narrow gaps 148 and 150, respectively, to permit each seat assembly to move independently of each other, where the front and rear seat assemblies follow the body's movement to accommodate the movement of the individual's body to influence the alignment of the pelvis.

In operation, when a downward force is exerted on the seat construction 110 such as a person sitting thereon, the four independent seat assemblies move independent of one another, thereby providing the person with a feeling of resilience and comfort to show that the seat construction has some give and play. The uniqueness of the seat construction 110 is that it follows the person's body movement as it rocks front to back, and further provides a flowing action to adjust and align the body of the individual as he or she sits on the seat construction. This is accomplished by the elastic means 132 and 142, and the springs 160, 162, 170, and 172 which give when a downward force is exerted thereto.

Referring to FIGS. 5, 7, and 8, by way of example, the overall length L, width W and height H of the seat construction 10 are approximately 16 inches by 13½ inches by 3 inches respectively. The front seat assemblies 114 and 116 are longer than the rear seat assemblies 118 and 120. By way of example, the length $L_1$ and width $W_1$ of the front seat assembly are approximately 9 inches by 6½ inches respectively. By way of example, the length $L_2$ and width $W_1$ of the rear seat assembly are approximately 6½ inches by 6½ inches respectively. It will be appreciated that the dimensions described above are merely one illustrative embodiment and can include many other comparable sets of dimensions.

The present invention conforms to conventional forms of manufacture or any other conventional way known to one skilled in the art. By way of example, the base plate 12, and the rigid support plates 134 and 144 can be made of plastic or metal material. By way of example, the elastic means 132 and 142, and the seat cushions 136 and 146 can be made of foam material, for example neoprene material.

Defined in detail, the present invention is a seat construction, comprising: (a) a base plate having an upper surface; (b) a pair of complementary rear seat assemblies affixed to the upper surface of the base plate and located on a rear section of the base plate for supporting a pelvis of a person, each rear seat assembly having a resilient frame shaped member made of foam material, a rigid support plate affixed to the frame shaped member, and a resilient seat cushion made of foam material affixed to the rigid support plate; (c) a pair of complementary front seat assemblies affixed to the upper surface of the base plate and located on a front section of the base plate for supporting thighs of the person, each front seat assembly having a resilient frame shaped member made of foam material, a rigid support plate affixed to the frame shaped member, and a resilient seat cushion made of foam material affixed to the rigid support plate, the pair of front seat assemblies being longer than the pair of rear seat assemblies; and (d) the front and rear seat assemblies positioned adjacent each other but spaced by longitudinal and transverse gaps to permit the each seat assembly to respond independently of each other when subjected to a force such as a weight of the person sitting on the each seat assembly; (e) whereby the front and rear seat assemblies follow the body's movement to correct the pelvis so that it influences a proper alignment of the person's body.

Defined broadly, the present invention is a seat construction, comprising: (a) a base having an upper surface; (b) a pair of first seat assemblies affixed to the upper surface of the base for supporting a pelvis of a person, each first seat assembly having elastic means, a support plate affixed to the elastic means, and a seat cushion affixed to the support plate; (c) a pair of second seat assemblies affixed to the upper surface of the base for supporting thighs of the person, each second seat assembly having elastic means, a support plate affixed to the elastic means, and a seat cushion affixed to the support plate; and (d) the first and second seat assemblies positioned adjacent each other but spaced by gaps to permit the each seat assembly to respond independently of each other when subjected to a force such as a weight of the person sitting on the each seat assembly; (e) whereby the first and second seat assemblies follow the body's movement to correct the pelvis so that it influences a proper alignment of the person's body.

Defined more broadly, the present invention is a seat construction, comprising: (a) a base; (b) at least two pairs of seat assemblies affixed to the base for respectively supporting a pelvis and thighs of a person sitting thereon, each seat assembly having elastic means, support means affixed to the elastic means, and seat means affixed to the support means; and (c) the at least two pairs of seat assemblies positioned adjacent each other but spaced by gaps to permit the each seat assembly to respond independently of each other when subjected to a force such as a weight of a person sitting on the each seat assembly; (d) whereby the at least two pairs of seat assemblies follow the body's movement to correct the pelvis so that it influences a proper alignment of the person's body.

Defined alternatively in detail, the present invention is a seat construction, comprising: (a) a base having an upper surface; (b) a pair of first seat assemblies affixed to the upper surface of the base for supporting a pelvis of a person, each first seat assembly having elastic means, a support plate affixed to the elastic means, and a seat cushion affixed to the support plate; (c) a first pair of opposite spaced apart heavy duty springs embedded within the each elastic means of the pair of first seat assemblies for further providing support when the person sits on the pair of first seat assemblies; (d) a first light spring embedded within the each elastic means of the pair of first seat assemblies and located remote from the pair of opposite heavy duty springs for further providing support when the person sits on the pair of first seat assemblies; (e) a pair of second seat assemblies affixed to the upper surface of the base for supporting thighs of the person, each second seat assembly having elastic means, a support plate affixed to the elastic means, and a seat cushion affixed to the support plate; (f) a second pair of opposite spaced apart heavy duty springs embedded within the each elastic means of the pair of second seat assemblies for further providing support when the person sits on the pair of second seat assemblies; (g) a second light spring embedded within the each elastic means of the pair of second seat assemblies and located remote from the second pair of opposite heavy duty springs for further providing support when the person sits on the pair of second seat assemblies; and (h) the first and second seat assemblies positioned adjacent each other but spaced by gaps to permit the each seat assembly to respond independently of each other when the force such as the weight of the person sitting on the each seat assembly; (i) whereby the first and second seat assemblies follow the body's movement to correct the pelvis so that it influences a proper alignment of the person's body.

Defined alternatively broadly, the present invention is a seat construction, comprising: (a) a base; (b) at least two pairs of seat assemblies affixed to the base for respectively supporting a pelvis and thighs of a person sitting thereon, each seat assembly having elastic means, support means affixed to the elastic means, and seat means affixed to the support means; (c) at least three spring means embedded within the each elastic means of the at least two pairs of seat assemblies for further providing support when the person sits on the at least two pairs of seat assemblies; and (d) the at least two pairs of seat assemblies positioned adjacent each other but spaced by gaps to permit the each seat assembly to respond independently of each other when subjected to a force such as a weight of a person sitting on the each seat assembly; (e) whereby the at least two pairs of seat assemblies follow the body's movement to correct the pelvis so that it influences a proper alignment of the person's body.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modifications in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. A seat construction, comprising:

a. a base plate having an upper surface;

b. a pair of complementary rear seat assemblies affixed to said upper surface of said base plate and located on a rear section of said base plate for supporting a pelvis of a person, each rear seat assembly having a resilient frame shaped member made of foam material, a rigid support plate affixed to the frame shaped member, and a resilient seat cushion made of foam material affixed to the rigid support plate;

c. a pair of complementary front seat assemblies affixed to said upper surface of said base plate and located on a front section of said base plate for supporting thighs of the person, each front seat assembly having a resilient frame shaped member made of foam material, a rigid support plate affixed to the frame shaped member, and a resilient seat cushion made of foam material affixed to the rigid support plate, the pair of front seat assemblies being longer than said pair of rear seat assemblies; and d. said front and rear seat assemblies positioned adjacent each other but spaced by longitudinal and transverse gaps to permit said each seat assembly to respond independently of each other when subjected to a force on said each seat assembly;

e. whereby said front and rear seat assemblies follow a body movement of a person to correct the pelvis so that it influences a proper alignment of the person's body.

2. The seat construction in accordance with claim 1, further comprising a handle affixed to a rear end of said base plate for carrying said seat construction.

3. The seat construction in accordance with claim 1, wherein said seat construction is portable.

4. A legless portable seat construction to be placed on top of a seat, chair or bench, comprising:

a. a base having an upper surface;

b. a pair of first seat assemblies affixed to said upper surface of said base for supporting a pelvis of a person, each first seat assembly having elastic means, a support plate affixed to the elastic means, and a seat cushion affixed to the support plate;

c. a pair of second seat assemblies affixed to said upper surface of said base for supporting thighs of the person, each second seat assembly having elastic means, a support plate affixed to the elastic means, and a seat cushion affixed to the support plate; and d. said first and second seat assemblies positioned adjacent each other but spaced by gaps to permit said each seat assembly to respond independently of each other when subjected to a force on said each seat assembly;

e. whereby said first and second seat assemblies follow a body movement of a person to correct the pelvis so that it influences a proper alignment of the person's body.

5. The seat construction in accordance with claim 4, further comprising a handle affixed to a rear end of said base for carrying said seat construction.

6. The seat construction in accordance with claim 4, wherein said each elastic means is generally of a frame shaped configuration.

7. The seat construction in accordance with claim 6, wherein said frame shaped configuration has a central cavity.

8. The seat construction in accordance with claim 4, wherein said each elastic means is made of foam material.

9. The seat construction in accordance with claim 4, wherein said each seat cushion is made of foam material.

10. The seat construction in accordance with claim 4, wherein said pair of second seat assemblies is longer than said pair of first seat assemblies.

11. The seat construction in accordance with claim 4, wherein said gaps include a longitudinal gap and a transverse gap.

12. A legless portable seat construction to be placed on top of a seat, chair or bench, comprising:

a. a base;

b. at least two pairs of seat assemblies affixed to said base for respectively supporting a pelvis and thighs of a person sitting thereon, each seat assembly having elastic means, support means affixed to the elastic means, and seat means affixed to the support means; and c. said at least two pairs of seat assemblies positioned adjacent each other but spaced by gaps to permit said each seat assembly to respond independently of each other when subjected to a force on said each seat assembly;

d. whereby said at least two pairs of seat assemblies follow a body movement of a person to correct the pelvis so that it influences a proper alignment of the person's body.

13. The seat construction in accordance with claim 12, further comprising a handle affixed to a rear end of said base for carrying said seat construction.

14. The seat construction in accordance with claim 12, wherein said each elastic means is of a generally frame shaped configuration.

15. The seat construction in accordance with claim 14, wherein said frame shaped configuration has a central cavity.

16. The seat construction in accordance with claim 12, wherein said each elastic means is made of foam material.

17. The seat construction in accordance with claim 12, wherein said each support means includes a rigid support plate.

18. The seat construction in accordance with claim 12, wherein said each seat means is made of foam material.

19. The seat construction in accordance with claim 12, wherein one pair of said at least two pairs of seat assemblies is longer than the other pair of said at least two pairs of seat assemblies.

20. The seat construction in accordance with claim 12, wherein said gaps include a longitudinal gap and a transverse gap.

21. A seat construction, comprising:

a. a base having an upper surface;

b. a pair of first seat assemblies affixed to said upper surface of said base for supporting a pelvis of a person, each first seat assembly having elastic means, a support plate affixed to the elastic means, and a seat cushion affixed to the support plate;

c. a first pair of opposite spaced apart heavy duty springs embedded within said each elastic means of said pair of first seat assemblies for further providing support when the person sits on said pair of first seat assemblies;

d. a first light spring embedded within said each elastic means of said pair of first seat assemblies and located remote from said pair of opposite heavy duty springs for further providing support when the person sits on said pair of first seat assemblies;

e. a pair of second seat assemblies affixed to said upper surface of said base for supporting thighs of the person, each second seat assembly having elastic means, a support plate affixed to the elastic means, and a seat cushion affixed to the support plate;

f. a second pair of opposite spaced apart heavy duty springs embedded within said each elastic means of said pair of second seat assemblies for further providing support when the person sits on said pair of second seat assemblies;

g. a second light spring embedded within said each elastic means of said pair of second seat assemblies and located remote from said second pair of opposite heavy duty springs for further providing support when the person sits on said pair of second seat assemblies; and h. said first and second seat assemblies positioned adjacent each other but spaced by gaps to permit said each seat assembly to respond independently of each other when subjected to a force on said each seat assembly;

i. whereby said first and second seat assemblies follow a body movement of a person to correct the pelvis so that it influences a proper alignment of the person's body.

22. The seat construction in accordance with claim 21, further comprising a handle affixed to a rear end of said base for carrying said seat construction.

23. The seat construction in accordance with claim 21, wherein said each elastic means is generally of a frame shaped configuration.

24. The seat construction in accordance with claim 23, wherein said frame shaped configuration has a central cavity.

25. The seat construction in accordance with claim 21, wherein said each elastic means is made of foam material.

26. The seat construction in accordance with claim 21, wherein said each seat cushion is made of foam material.

27. The seat construction in accordance with claim 21, wherein said pair of second seat assemblies is longer than said pair of first seat assemblies.

28. The seat construction in accordance with claim 21, wherein said gaps include a longitudinal gap and a transverse gap.

29. A seat construction, comprising:

a. a base;

b. at least two pairs of seat assemblies affixed to said base for respectively supporting a pelvis and thighs of a person sitting thereon, each seat assembly having elastic means, support means affixed to the elastic means, and seat means affixed to the support means;

c. at least three spring means embedded within said each elastic means of said at least two pairs of seat assemblies for further providing support when the person sits on said at least two pairs of seat assemblies; and d. said at least two pairs of seat assemblies positioned adjacent each other but spaced by gaps to permit said each seat assembly to respond independently of each other when subjected to a force on said each seat assembly;

e. whereby said at least two pairs of seat assemblies follow a body movement of a person to correct the pelvis so that it influence a proper alignment of the person's body.

30. The seat construction in accordance with claim 29, further comprising a handle affixed to a rear end of said base for carrying said seat construction.

31. The seat construction in accordance with claim 29, wherein said each elastic means is generally a frame shaped configuration.

32. The seat construction in accordance with claim 31, wherein said frame shaped configuration has a central cavity.

33. The seat construction in accordance with claim 29, wherein said each elastic means is made of foam material.

34. The seat construction in accordance with claim 29, wherein said each support means includes a rigid support plate.

35. The seat construction in accordance with claim 29, wherein said each seat means is made of foam material.

36. The seat construction in accordance with claim 29, wherein one pair of said at least two pairs of seat assemblies is longer than the other pair of said at least two pairs of seat assemblies.

37. The seat construction in accordance with claim 29, wherein said gaps include a longitudinal gap and a transverse gap.

38. The seat construction in accordance with claim 29, wherein said at least three spring means include two opposite heavy duty springs and one light spring.

* * * * *